US005418553A

United States Patent [19]

Connolly

[11] Patent Number: 5,418,553

[45] Date of Patent: May 23, 1995

[54] THERMAL PRINT HEAD WITH OPTIMUM THICKNESS OF THE THERMAL INSULATION UNDER-LAYER AND METHOD OF DESIGNING THE SAME

[75] Inventor: Jeremiah F. Connolly, San Diego, Calif.

[73] Assignee: Eastman Kodak Company, Rochester, N.Y.

[21] Appl. No.: 37,770

[22] Filed: Mar. 26, 1993

[51] Int. Cl.[6] ..... B41J 2/325; B41J 2/335

[52] U.S. Cl. ..... 347/200

[58] Field of Search ..... 346/76 PH; 400/120

[56] References Cited

U.S. PATENT DOCUMENTS 4,621,271 11/1986 Brownstein ..... 346/76 PH 4,672,392 6/1987 Higeta et al. ..... 346/76 PH

*Primary Examiner*—Huan H. Tran

*Attorney, Agent, or Firm*—William F. Noval

[57] ABSTRACT

A thermal printing system includes a heating element with an insulation under-layer of optimal thickness. A method for determining the optimal thickness of such insulation under-layer using equations for the transient temperature distribution at the dye donor/image receiver interface is described. These equations account for the printing system parameters which have the most significant impact on the image formation process.

22 Claims, 4 Drawing Sheets

THERMAL PRINT HEAD WITH OPTIMUM THICKNESS OF THE THERMAL INSULATION UNDER-LAYER AND METHOD OF DESIGNING THE SAME

BACKGROUND OF THE INVENTION

1. Field of the Invention

This invention relates to thermal printing and more particularly to a thermal print head with improved thermal performance when pulsed using a Pulse Count Modulation scheme and to a method of designing the same.

2. Background of the Invention

Typical apparatus and operation of thermal printing systems is described in U.S. Pat. No. 4,621,271 issued in the name of Brownstein. FIG. 1 is reproduced from such patent and shows a schematic of a typical thermal printer. In brief, such systems are described as comprising a printer apparatus, a carrier web (often called "donor") containing dye available for transference, a receiver (such as paper), and a print head assembly formed of a plurality of individual thermal elements (often called "pixels" or "dots"). Typically, the receiver is fixedly attached to a drum which rotates in a stepped or continuous fashion as regulated by a timing and registration controller within the apparatus. Printing occurs when the imaging controller for the system directs that a particular thermal pixel be heated to the printing temperature. Typically, such heating occurs by flowing electricity through the resistive element which forms the key active component of the thermal pixel. The resistive element heats the thermal pixel. The heated thermal pixel is in contact with the carrier web (donor), and dye is transferred when the temperature at the donor/receiver interface reaches some critical transfer temperature such as the glass transition temperature of the receiver (in dye diffusion thermal transfer). Transference of the dye can be by diffusion, sublimation or other transfer process. After transfer of the dye to the receiver at the desired density, the imaging controller then directs that the thermal pixel be de-energized, and dye transfer ceases once the temperature at the donor/-receiver interface returns to temperatures below the glass transition temperature. If the thermal pixel were not de-energized, the donor would in time "burn", i.e., undergo visco-plastic deformation.

As the system is described above, key variables affecting the rate (and therefore the pixel density and apparatus speed) of dye transfer at a particular pixel include the following: 1) time during which thermal pixel is energized; 2) power density to thermal pixel; 3) initial donor, print head, and receiver temperatures; 4) receiver glass transition temperature; 5) donor "burn" (visco-plastic deformation) temperature; and 6) thermal characteristics of the print head. This patent is directed primarily toward optimization of the thermal characteristics of the print head, although the teachings of this patent can also be used to optimize other elements of the system.

FIG. 2 shows a schematic of a typical print head thermal pixel structure. Key elements include the substrate, 1; thermal insulation under-layer, 2; resistor, 3; electrical lead, 4; and protective film, 5. Although the thermal characteristics of each element affects overall thermal performance of the print head, the element most affecting overall thermal performance is the thermal insulation under-layer, 2. In turn, key variables of the thermal insulation under-layer 2 are its thickness, h, and its thermal conductivity, K.

Prior art includes efforts to optimize the thickness range of the insulation under-layer 2 when the print head is pulsed using Pulse Width Modulation (PWM) schemes where the resistor is turned on at most once per print cycle. See, U.S. Pat. No. 4,672,392 issued in the name of Higeta et al. However, Higeta was restricted to PWM energizing schemes and ignores system parameters such as initial temperatures and other key variables listed above which strongly influence overall thermal performance of the print head.

In the prior art, Pulse Count Modulation (PCM) is known to overcome many of the image defects resulting from PWM energizing schemes by permitting better control of resistor 3 temperature. Among the advantages of PCM systems are: better tone scale, higher optical densities, reduced printing artifacts, and enhanced gray scale without distortion of the dye donor. PCM schemes are more complex than PWM schemes, however. Other trends in thermal printing include faster printing times by reducing line printing times from the current 32 milliseconds per line to under 10 milliseconds per line. Such faster speeds require more energy efficient print heads and receivers with lower glass transition temperatures ($T_g$). The key to making more energy efficient heads is reducing the thermal conductivity of the thermal insulation under-layer 2. The materials currently used do not approach the lowest possible thermal conductivities available in materials. Thus, the trend will be to using materials with lower thermal conductivity.

As the thermal characteristics of the components are changed, the head performance can be tuned to optimize overall integrated system performance. As discussed above, optimization of the thermal insulation under-layer 2 is key to achieving more efficient thermal characteristics in print head performance. In particular, a need has been felt for thermal print heads designed with the optimal thickness, h, of the insulation under-layer 2 for various thermal conductivity, K, and other key parameter values. Also needed is a method of designing such heads. Since print heads can be further optimized for either optimal response time or optimal power consumption, what is further needed are print heads optimized for either shorter response time performance or lower power consumption performance.

SUMMARY OF THE INVENTION

The present invention provides a thermal printing system with a thermal print head containing an insulation under-layer of optimal thickness. Optimizing the thickness of this insulation under-layer becomes increasingly important as compositions with improved thermal conductivities are introduced into thermal print heads. The present invention also presents a method for determining optimal thickness of such insulation under-layer. The method involves use of an equation for the transient temperature distribution at the dye donor/image receiver interface. This equation accounts for the print system parameters which have the most significant impact on the image formation process.

The present invention also provides the following relationships between K, the thermal conductivity of the insulation under-layer of the thermal print head, and h, the thickness of such layer:

$K \geqq 1.2$ W/m.C, then 50 μm $\leqq h \leqq$ 70 μm $0.6 \leqq K \leqq 1.2$ W/m.C, then 40 μm $\leqq H \leqq$ 60 μm $K \leqq 0.6$ W/m.C, then 30 μm $\leqq h \leqq$ 50 μm Within those ranges, the present invention further provides that the thermal print head can be optimized for system response time by selecting a thickness, h, at the low end of the above range or, conversely, optimized for power density by selecting a thickness, h, at the high end of the above range.

Also, since the present invention provides a quantitative relationship between each of the key variables affecting thermal performance of the system, the present invention allows the thickness, h, of the thermal insulation under-layer to be optimized for variations in another variable, assuming all other key variables remain fixed.

The advantages of this invention include a technique for determining the optimum thickness h for the insulation under-layer 2 as superior lower conductivity materials become available and as other parameters affecting performance of the thermal printing system are changed. Among the variables which may change are: insulation under-layer thickness h; rise time; print line times; initial temperatures (equal to or above ambient); and power density levels (which may change as receivers with lower glass transition temperatures are developed). In general, the invention allows optimization of all the major system variables affecting the heat generation in a print head pulsed with PCM.

DESCRIPTION OF THE PREFERRED EMBODIMENTS

Referring again to FIG. 2, the insulation under-layer 2 has a thermal conductivity, K, and a thickness, h (in μm). The materials generally used in current art for such thermal insulation under-layers are ceramic glazes with bulk conductivities ranging from 0.8 to 1.4 W/m.C. Most available glazes have thermal conductivities within the 1.0 to 1.2 W/m.C range. Other materials, such as modified polyimides have been produced which have thermal conductivities less than 0.3 W/m.C. To date, however, process constraints have prevented such low conductivity materials from gaining common use. Progress is expected to be made in applying these low conductivity materials, however, and the present invention applies for the thermal conductivities, K, as low as 0.3 W/m.C. The invention can apply to even lower thermal conductivities if the parameters of the equations set forth below are derived and applied in the invention.

Figure 3:
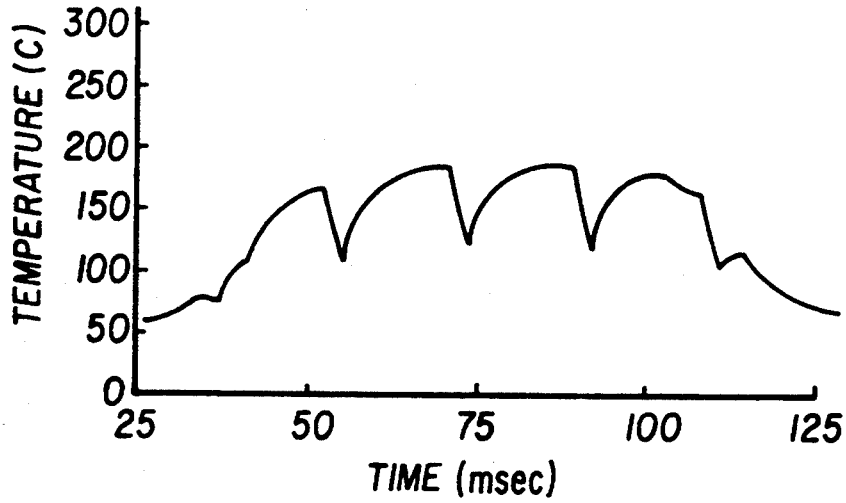
FIG. 3 is a graph showing the thermal response to PCM mode signals at a single point in the donor/-receiver interface as a function of time.

FIG. 3 illustrates the predicted transient temperature at a point in the donor/receiver interface as it travels over a thermal print head at a speed of 0.25 inches per second. The head is being pulsed in a PCM mode at D-max for each line, using a double hit in which pulsing of a line is broken into two discrete pulsed parts: pulse for 16 msec., off for 2.5 msec., and then pulse again for 16 msec. As can be seen, each 16 msec. pulse results in a characteristic sloping rise in temperature accompanied by a cooling before the next pulse begins.

Figure 4:
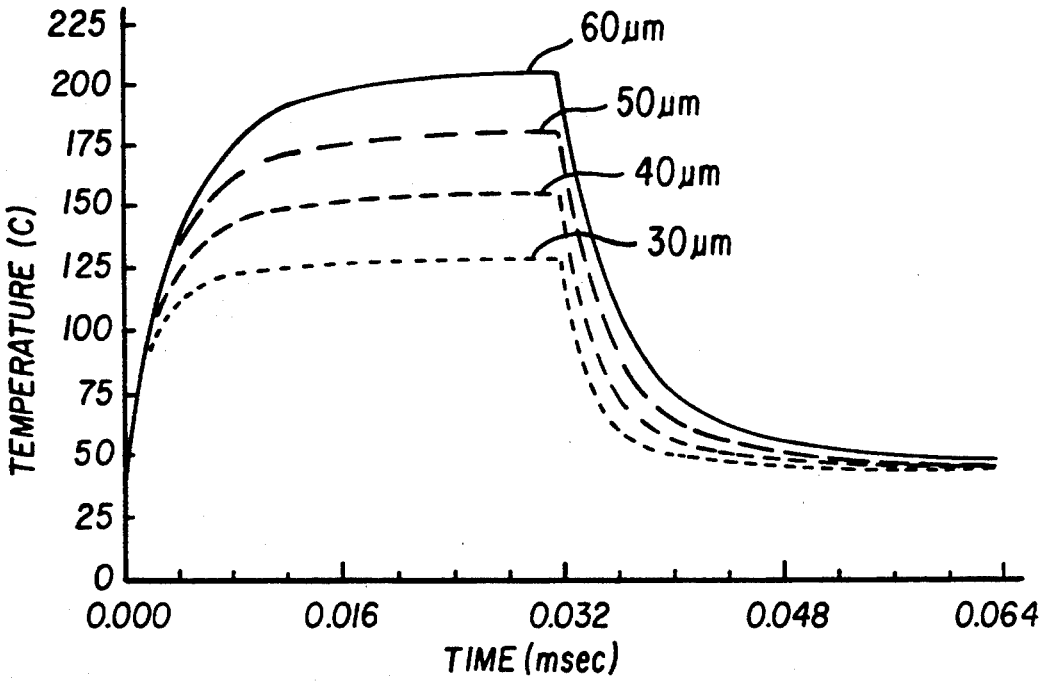
FIG. 4 is a graph showing the effect of insulation under-layer thickness, h, upon peak temperature and rise time of a print head at the donor/receiver interface.

FIG. 4 shows the effect of insulation thickness upon the rate and height of donor/receiver interface temperature during a typical PCM pulse. In this example, thermal conductivity, K, is held constant at 1.2 W/m.C while thicknesses, h, ranging from 60 μm to 30 μm are charted. As can be seen, increasing the thickness, h, results in a drop in the temperature rise time and cool down time. Decreasing the thickness also results in lowered achieved temperatures.

Figure 5:
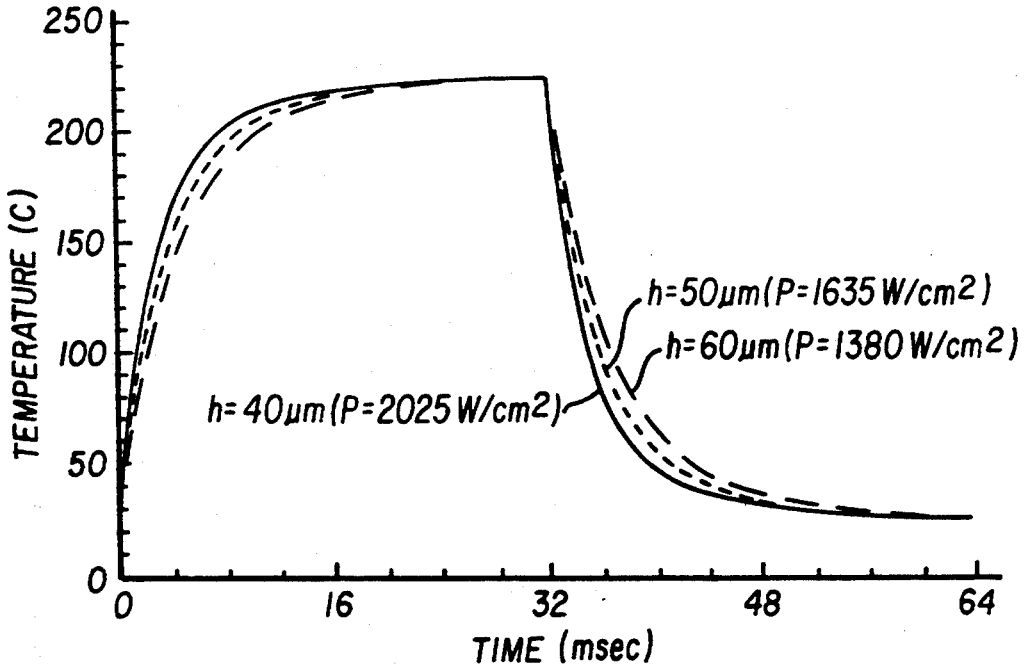
FIG. 5 is a graph showing the effect that the insulation under-layer thickness has on the donor/receiver interface temperature for a fixed insulation under-layer thermal conductivity and initial temperature.

FIG. 5 shows a set of temperature response curves under conditions similar to those in FIG. 4 except that the power density, P, of the current has been increased in order that each print head reach the same peak temperature at the end of a printed line time. Each decrease of 10 μm in thickness h requires approximately a 30 percent rise in power density to achieve the same peak temperature. FIGS. 4 and 5 when taken together thus illustrate the compromises between optimizing power density, rise time, and peak temperature while varying power density and/or insulation thickness, h.

Figure 6:
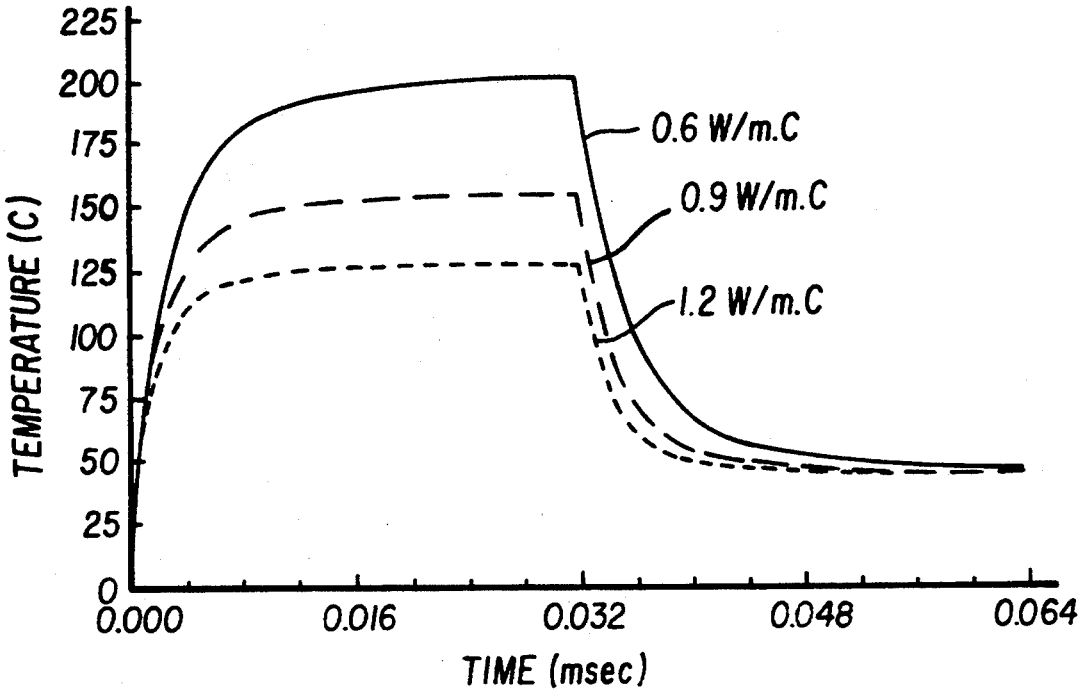
FIG. 6 is a graph showing the effect of thermal conductivity, K, upon peak temperature and rise time of a thermal print head at the donor/receiver interface.

FIG. 6 similarly reflects the effects of various thermal conductivities, K, upon rise time and peak temperature. As can be seen, the lower the value of K, the better thermal performance of the head. Hence, insulation under-layers with lower K values are expected to be developed. As stated above, the present invention is directed toward optimization of thickness, h, by making h a dependent variable responsive to changes in other key parameters of thermal printing systems. Such optimization is particularly critical with the introduction of improved insulation under-layers with lower K values than found in current art.

Figure 7:
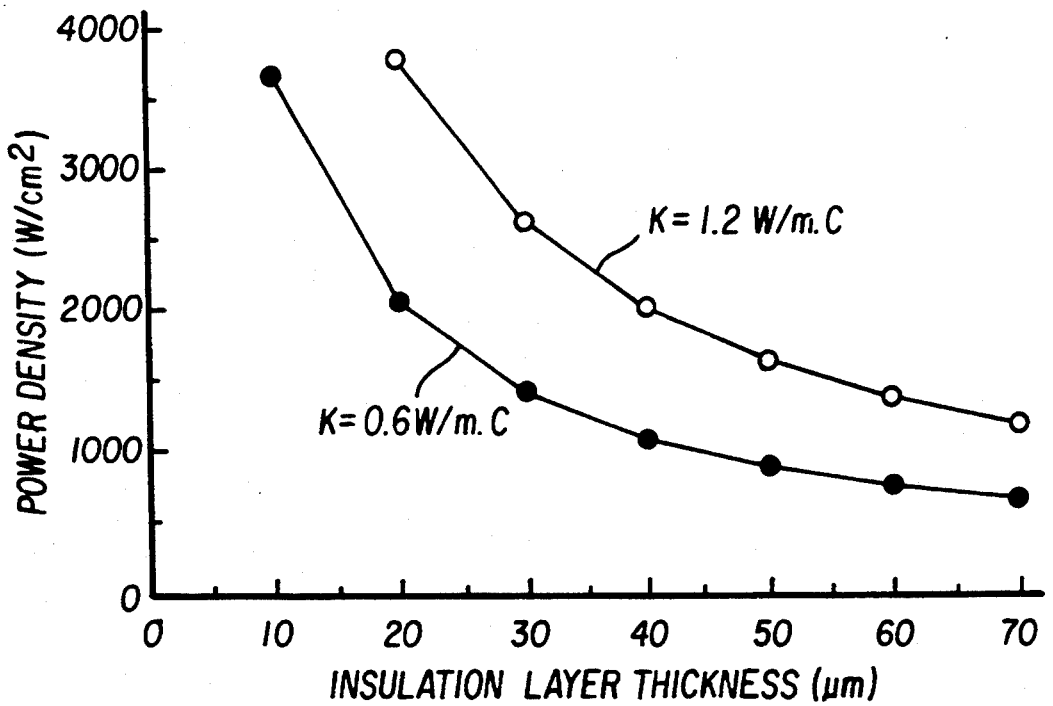
FIG. 7 shows power density required to achieve the maximum allowable temperature (chosen at 225° C. for illustration) after a particular line print time for 2 insulation under-layer thermal conductivities.

FIG. 7 shows the relationship between power density and insulation thickness, h, for insulation under-layers with K values between 1.2 and 0.6 W/m.C. As can be seen, for very thin insulation under-layers, power requirements grow very quickly. For $K=1.2$ W/m.C, this rise in power density accelerates rapidly when h is less than 50 μm. For $K=0.6$ W/m.C, this acceleration does not occur until the insulation under-layer is thinned to 30 μm.

In addition to the above variables in thermal printing systems, thermal print heads also typically have a protective layer, 5, covering the resistor, 3, and leads, 4. However, the thermal characteristics of the protective layer, 5, have very little impact on the thermal performance of the print head over a reasonable range of commonly used materials and thicknesses. The thermal characteristics of this layer, therefore, can typically be ignored.

Based on relationships reflected in FIGS. 3–7, it can be shown that the following quantitative relationships apply to thermal printing systems:

Equation (1)—TEMPERATURE RISE CURVE $$T(t)=T_f-(T_f-T_0)\{\alpha e^{-t/\tau 1}+(1-\alpha)e^{-t/\tau 2}\};\quad 0\leqq t\leqq t1$$

Equation (2)—TEMPERATURE COOLDOWN CURVE $$T(t)=T_0+(T_1-T_0)\{\alpha e^{(t1-t)/\tau 1}+(1-\alpha)e^{(t1-t)/\tau 2}\};\quad t\geqq t1$$

where $t_f$ is time (in milliseconds); $T_0=T(t=0)$ and is the initial temperature at the donor/receiver interface prior to printing; $T_1=T(t=t1=$the line print time); $T_f$ equals the peak temperature to which the dye donor and image receiver interface asymptotes after some time and is derived from Equation (4) below; $\alpha$=a constant (ranging from 0.65 to 0.85 with optimal value of 0.75) which was derived by standard curve fitting techniques (In this case, using Statgraphics software published by Statistical Graphics Corporation); and $\tau_i$=time constants (i=1,2) as derived from Equation (3) below.

Equation (3)—VALUE OF $\tau_i$ $$\tau_i=C_i(h+\alpha_i)/(K+\beta_i)$$

where the values of $C_i$, $\alpha_i$, and $\beta_i$ are listed in Equation (5) below and h (in $\mu$m) is the height of the insulation under-layer 2 while K (in W/m.C) is the thermal conductivity of such insulation under-layer. The heat capacity ($\rho$C) of the particular insulation under-layer also affects the value of $\tau_i$. In the experiments performed, $\rho$C equaled $1.86\times10^6$ J/m$^3$.C. However, the results showed that the value of $\tau_i$ is not very sensitive to the heat capacity within reasonable ranges, and $\rho$C has therefore been omitted from Equation (3) for simplification purposes.

Equation (4)—VALUE OF $T_f$ $$T_f=T_0+C_3\,P(h+\alpha_3)/(K+\beta_3)$$

where the values of $C_3$, $\alpha_3$, and $\beta_3$ are listed in Equation (5) below; h (in $\mu$m) is the thickness of the insulation under-layer 2; K (in W/m.C) is the thermal conductivity of such layer; P (in Kilo Watts/cm$^2$) is the applied power density; and $T_0$ (in C°) is the initial temperature of the print head and receiver interface. As exemplified in FIGS. 4, 5 and 6, the asymptotic value of $T_f$ may be reached at a time longer or shorter than the line print time.

Equation (5)—Curve Fitting Constants (Optimal values in parentheses)

For $\tau_1$, Equation (3): $C_1$ = 0.09 to 0.11 (0.10);
$\alpha_1$ = 0.0 to −15.0 (−8.0);
$\beta_1$ = 0.11 to 0.21 (0.16).

For $\tau_2$, Equation (3): $C_2$ = 0.18 to 0.34 (0.25);
$\alpha_2$ = 35.0 to 125.0 (70.0);
$\beta_2$ = 1.6 to 3.1 (2.25);

For Equation (4): $C_3$ = 2.89 to 3.2 (3,045);
$\alpha_3$ = −2.0 to 6.0 (2.5);
$\beta_3$ = 0.08 to 0.12 (0.10).

where each of these values is derived using standard curve fitting techniques (implemented in this case through Statgraphics software) for curves derived for h and K falling within the ranges $10\leqq h\leqq 100$ $\mu$m and $0.3\leqq K\leqq 1.2$ W/m.C. For values of h and K which fall outside these ranges, standard curve fitting techniques will similarly yield applicable solutions to Equation (5).

Figure 8:
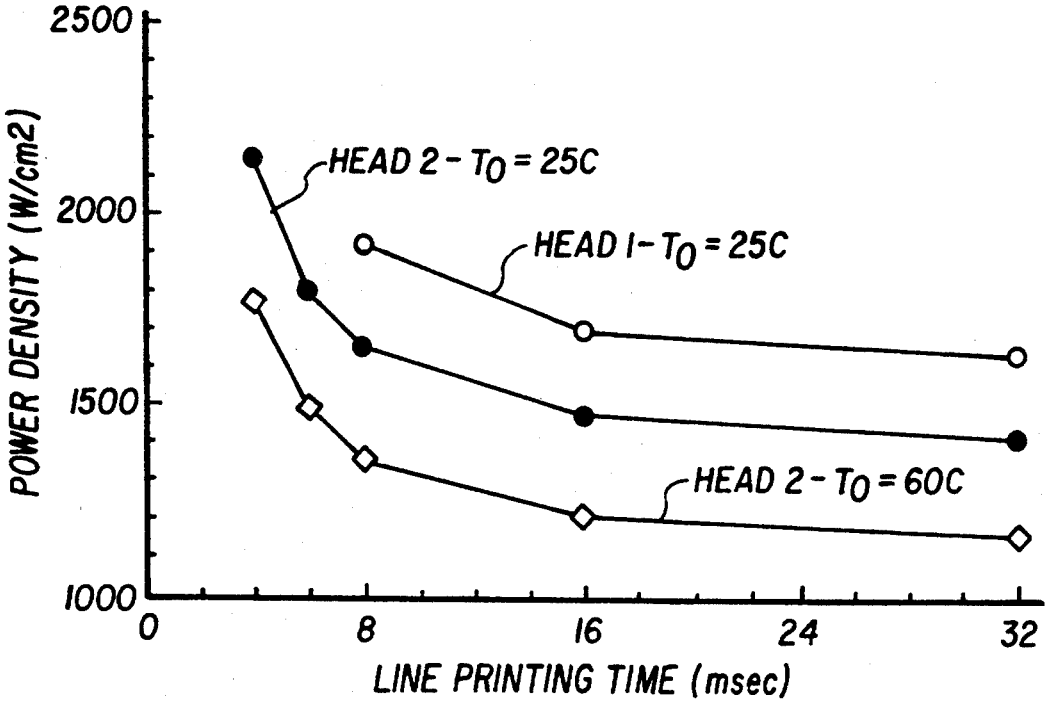
FIG. 8 shows the power density required to produce the maximum allowable temperature (chosen at 225° C. for illustration) at the end of a line print for different insulation under-layer thicknesses, thermal conductivities and initial temperatures.

For the sake of illustration of the above formula, two head configurations are compared in FIG. 8 for thermal performance, namely Head 1 (with K=1.2 W/m.C and h=50 $\mu$m, representative of current technology) and Head 2 (with K=0.6 W/m.C and h=30 $\mu$m, illustrating the predictive power of the formula for future technologies). FIG. 8 shows the power density required to produce the maximum allowable temperature (chosen as 225° C. for illustration) at the end of a line print time for different insulation under-layer thickness, thermal conductivity and initial temperature. As shown, the power requirements of Head 2 are 86% of those for the current head technology under the condition of a 32 millisecond line print time. FIG. 8 also shows that shorter line times are available for much lower input power values than print heads with conventional thermal insulation under-layers. By maintaining the print head at an elevated temperature (60° C. chosen for illustration), still lower resistor powers can be used.

Figure 9:
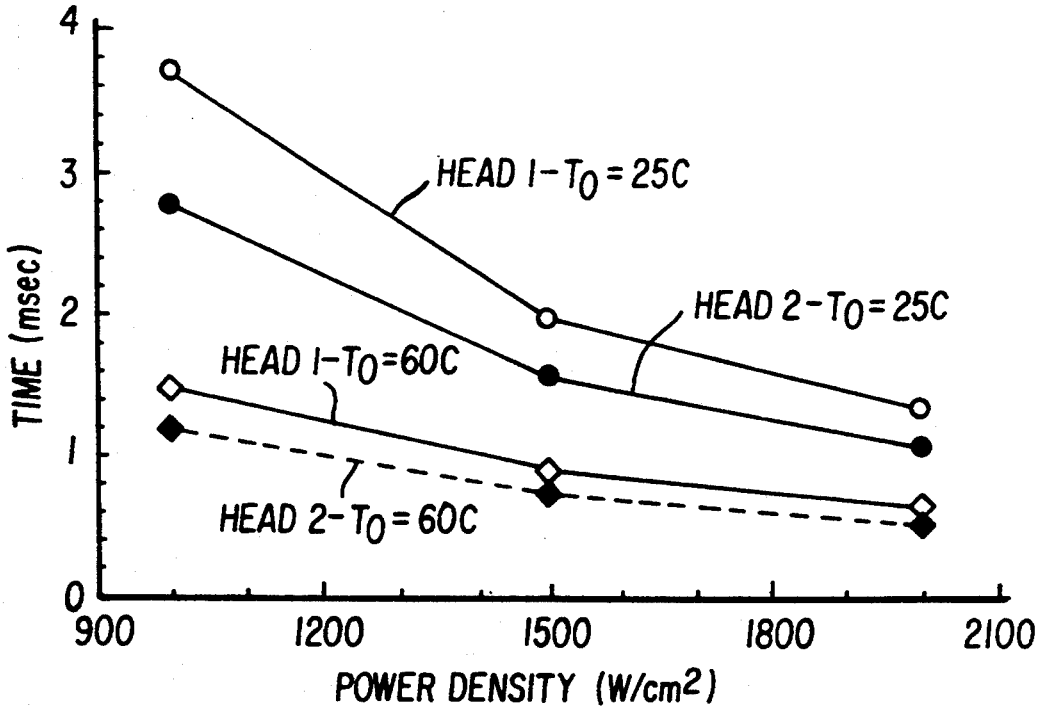
FIG. 9 shows the minimum time to reach temperature (chosen as 100° C.) suitable for diffusion to occur at a reasonable rate as a function of power density for different insulation under-layer thicknesses, thermal conductivities and initial temperatures.

FIG. 9 compares the rise time required to reach a certain minimum temperature of a head with a conventional insulation under-layer to the similar rise time of a head with improved thermal conductivities. The minimum temperature (chosen as 100° C. for illustration) would be chosen as that minimum temperature which is suitable for dye diffusion to occur at a reasonable rate. FIG. 9 charts rise time as a function of power density for different insulation under-layer thicknesses, thermal conductivities and initial temperatures. The results show that the head with improved thermal conductivity reaches the desired temperature faster than a conventional head, enabling a greater range of optical density in the print.

The invention has been described in detail with illustration of a particular embodiment thereof, but it will be understood that variations and modifications, particularly in the relation to the Pulse Count Modulation pulsing scheme and its duty cycle, can be effected within the spirit and scope of the invention.

Figure 1:
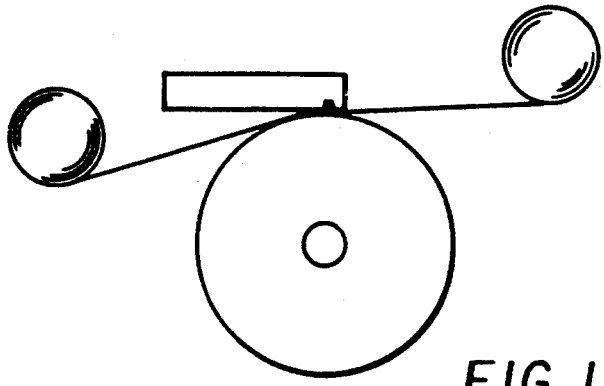
FIG. 1 is a schematic drawing of a typical thermal printing system.
Figure 2:
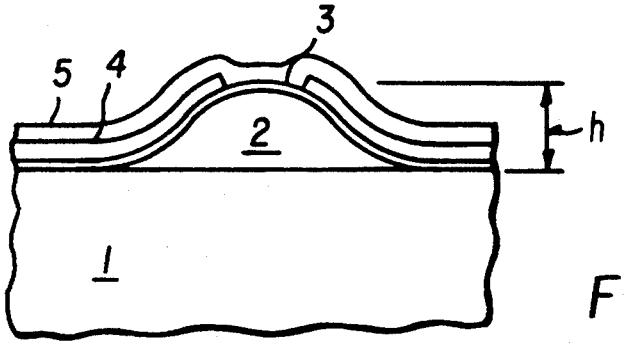
FIG. 2 shows a typical thermal print head structure.

| PARTS LIST |
|---|
| FIG. 2 - Structure of thermal print head pixel: |
| (1) substrate |
| (2) thermal insulation under-layer |
| (3) resistor |
| (4) electrical lead |
| (5) protective film |

What is claimed:

1. A thermal printing system comprising:

a) a thermal print head having an initial temperature $T_0$ (which can be above ambient) and including an electrically resistive heating element having an electrode area, a substrate, and a thermal insulation under-layer interposed between said electrically resistive heating element and said substrate, said thermal insulation under-layer having thickness, h, between 10 and 100 μm, and thermal conductivity, K, in the range $0.3 \leqq K \leqq 1.2$ W/m.C;

(b) said electrically resistive heating element adapted to receive electricity in pulses in accordance with a pulse count modulation scheme with a pre-selected printing time t1, said electricity having power density P (in kilo-W/cm$^2$) over said electrode area;

(c) a donor containing heat transferable dye with a pre-determined maximum temperature sustainable by said donor being $T_{max}$;

(d) an image receiver with a pre-determined minimum temperature $T_{min}$ at which dye transfer from said donor occurs at a reasonable rate for image formation;

(e) further wherein said thickness, h, of said thermal insulation under-layer is within the range determined in accordance with the following:

$$T(t)=T_f-(T_f-T_0)\{\alpha e^{-t/\tau 1}+(1-\alpha)e^{-t/\tau 2}\};\quad 0 \leqq t \leqq t1 \tag{1}$$

$$T(t)=T_0+(T_1-T_0)\{\alpha e^{(t1-t)/\tau 1}+(1-\alpha)e^{(t1-t)/\tau 2}\};\quad t \geqq t1 \tag{2}$$

where t is time (in milliseconds); $T_0=T(t=0)$ and is the initial temperature at the donor/receiver interface prior to printing; $T_1=T(t=t1=$the line print time); $T_f$ is the peak temperature to which the dye donor and image receiver asymptotes and is derived from Equation (4) below; $\alpha$=a constant ranging from 0.65 to 0.85; and $\tau_i$=time constants (i=1,2) as derived from Equation (3) below;

$$\tau_i=C_i(h+\alpha_i)/(K+\beta_i) \tag{3}$$

where the values of $C_i$, $\alpha_i$, and $\beta_i$ are constants $$T_f=+T_0\ C_3\ P(h+\alpha_3)/(K+\beta_3) \tag{4}$$

where the values of $C_3$, $\alpha_3$, and $\beta_3$ are constants.

2. A thermal printing system in accordance with claim 1, wherein the values of the constants are as follows:

For $\tau_1$, Equation (3): $C_1 = 0.09$ to 0.11
$\alpha_1 = 0.0$ to $-15.0$
$\beta_1 = 0.11$ to 0.21

-continued

For $\tau_2$, Equation (3): $C_2 = 0.18$ to 0.34
$\alpha_2 = 35.0$ to 125.0
$\beta_2 = 1.6$ to 3.1

For Equation (4): $C_3 = 2.89$ to 3.2
$\alpha_3 = -2.0$ to 6.0
$\beta_3 = 0.08$ to 0.12.

3. A thermal printing system in accordance with claim 1, wherein the values contained within claim 2 approximate the following:

| | | |
|---|---|---|
| $C_1 = 0.10$ | $\alpha_1 = -8.0$ | $\beta_1 = 0.16$ |
| $C_2 = 0.25$ | $\alpha_2 = 70.0$ | $\beta_2 = 2.25$ |
| $C_3 = 3.045$ | $\alpha_3 = 2.5$ | $\beta_3 = 0.10.$ |

4. A thermal printing system in accordance with claim 1, wherein the value of $\alpha$ in Equations (1) and (2) approximates 0.75.

5. In a thermal printing system in accordance with claim 1, the thermal insulation under-layer characterized in that if $K \geqq 1.2$ W/m.C, then 50 μm $\leqq h \leqq$ 70 μm.

6. In a thermal printing system in accordance with claim 1, the thermal insulation under-layer characterized in that if $0.6 \leqq K \leqq 1.2$ W/m.C, then 40 μm $\leqq h \leqq$ 60 μm.

7. In a thermal printing system in accordance with claim 1, the thermal insulation under-layer characterized in that if $K \leqq 0.6$ W/m.C, then 30 μm $\leqq h \leqq$ 50 μm.

8. A thermal printing system in accordance with claims 5, 6, or 7, wherein the thickness, h, of said thermal insulation under-layer is divided into upper. and lower thickness ranges and wherein h is optimized for response time by choosing the lower end of the thickness range.

9. A thermal printing system in accordance with claims 5, 6, or 7, wherein the thickness, h, of said thermal insulation under-layer is divided into upper and lower thickness ranges and wherein h is optimized for power density by choosing the upper end of the thickness range.

10. A thermal printing system in accordance with claim 1, wherein the thickness, h, of said thermal insulation under-layer is optimized for a range of available power densities when all other system parameters affecting temperature, as specified in claim 1, are fixed.

11. A thermal printing system in accordance with claim 1, wherein the thickness, h, of said thermal insulation under-layer is optimized for a range of minimum allowable times to reach the temperature $T_{min}$ when all other system parameters specified in claim 1, are fixed.

12. A thermal printing system in accordance with claim 1, wherein the thickness, h, of said thermal insulation under-layer is optimized for a range of maximum allowable temperatures $T_{max}$, when all other system parameters specified in claim 1 are fixed.

13. A thermal printing system in accordance with claim 1, wherein the thickness, h, of said thermal insulation under-layer is optimized for a range of initial temperatures $T_0$, when all other system parameters specified in claim 1 are fixed.

14. A thermal printing system in accordance with claim 1, wherein the thickness, h, of said thermal insulation under-layer is optimized for a range of line print time, t1, when all other system parameters specified in claim 1 are fixed.

15. A thermal printing system in accordance with claim 1, wherein the thickness, h, of said thermal insulation under-layer is optimized for a range of thermal conductivities K, when all other system parameters specified in claim 1, are fixed.

16. A thermal printing system in accordance with claim 1, wherein the thermal conductivity K is less than 0.3 W/m.C and wherein the values contained within claim 2 are recomputed to reflect such changed parameter in accordance with standard curve fitting techniques.

17. A thermal printing system in accordance with claim 1, wherein the thickness, h, is less than 10 μm and wherein the values contained within claim 2 are recomputed to reflect such changed parameter in accordance with standard curve fitting techniques.

18. A thermal printing system in accordance with claim 1, wherein the thickness, h, is greater than 100 μm and wherein the values contained within claim 2 are recomputed to reflect such changed parameter in accordance with standard curve fitting techniques.

19. A method of optimizing thermal performance of a thermal printing system, said method comprising the steps of:

a) providing a thermal print head having an initial temperature $T_O$ (which can be above ambient) and including an electrically resistive heating element having an electrode area, a substrate, and a thermal insulation under-layer interposed between said electrically resistive element and said substrate, said thermal insulation under-layer having thickness, h, between 10 and 100 μm, and thermal conductivity, K, in the range $0.3 \leqq K \leqq 1.2$ W/m.C;

(b) supplying electricity to said electrically resistive element in pulses in accordance with a pulse count modulation scheme with pre-selected printing time T1, said electricity having power density P (in kilo-W/cm$^2$) over said electrode area;

(c) providing a donor containing heat transferable dye with a pre-determined maximum temperature sustainable by said donor being $T_{max}$;

(d) providing an image receiver with a predetermined minimum temperature $T_{min}$ at which dye transfer from said donor occurs at a reasonable rate for image formation;

further wherein said thickness, h, of said thermal insulation under-layer is within the range determined in accordance with the following:

$$T(t)=T_f-(T_f-T_0)\{\alpha e^{-t/\tau 1}+(1-\alpha)e^{-t/\tau 2}\};\quad 0 \leqq t \leqq t1 \tag{1}$$

$$T(t)=T_0+(T_1-T_0)\{\alpha e^{(t1-t)/\tau 1}+(1-\alpha)e^{(t1-t)/\tau 2}\};\quad t \geqq t1 \tag{2}$$

where t is time (in milliseconds); $T_O=T(t=0)$ and is the initial temperature at the donor/receiver interface prior to printing; $T_1=T(t=t1=$the line print time); $T_f$ is the peak temperature to which the dye donor and image receiver asymptotes and is derived from Equation (4) below; $\alpha$=a constant ranging from 0.65 to 0.85; and $\tau_i$=time constants (i=1,2) as derived from Equation (3) below;

$$\tau_i=C_i(h+\alpha_i)/(K+\beta_i) \tag{3}$$

where the values of $C_i$, $\alpha_i$, and $\beta_i$ are constants $$T_f=+T_0\, C_3\, P(h+\alpha_3)/(K+\beta_3) \tag{4}$$

where the values of $C_3$, $\alpha_3$, and $\beta_3$ are constants.

20. The method of claim 19, wherein the values of the constants are as follows:

For $\tau_1$, Equation (3): $C_1$ = 0.09 to 0.11
$\alpha_1$ = 0.0 to −15.0
$\beta_1$ = 0.11 to 0.21

For $\tau_2$, Equation (3): $C_2$ = 0.18 to 0.34
$\alpha_2$ = 35.0 to 125.0
$\beta_2$ = 1.6 to 3.1

For Equation (4): $C_3$ = 2.89 to 3.2
$\alpha_3$ = −2.0 to 6.0
$\beta_3$ = 0.08 to 0.12.

21. The method of claim 19 wherein the values of the constants approximate the following:

| | | | |
|---|---|---|---|
| $C_1 = 0.10$ | $\alpha_1 = -8.0$ | $\beta_1 = 0.16$ | Equation (5) |
| $C_2 = 0.25$ | $\alpha_2 = 70.0$ | $\beta_2 = 2.25$ | |
| $C_3 = 3.045$ | $\alpha_3 = 2.5$ | $\beta_3 = 0.10.$ | |

22. The method of claim 19 wherein the value of $\alpha$ in Equations (2) and (3) approximates 0.75.

* * * * *